US010597187B2

(12) United States Patent
Kitora et al.

(10) Patent No.: US 10,597,187 B2
(45) Date of Patent: Mar. 24, 2020

(54) DOUBLED-WALLED CONTAINER

(71) Applicants: Shuichi Kitora, Tokyo (JP); Keisuke Miyairi, Tokyo (JP)

(72) Inventors: Shuichi Kitora, Tokyo (JP); Keisuke Miyairi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 39 days.

(21) Appl. No.: 16/063,613

(22) PCT Filed: Nov. 15, 2016

(86) PCT No.: PCT/JP2016/083838
§ 371 (c)(1),
(2) Date: Jun. 18, 2018

(87) PCT Pub. No.: WO2017/110310
PCT Pub. Date: Jun. 29, 2017

(65) Prior Publication Data

US 2018/0370671 A1 Dec. 27, 2018

(30) Foreign Application Priority Data

Dec. 25, 2015 (JP) ..... 2015-255229

(51) Int. Cl.
*B65D 1/02* (2006.01)
*B65D 23/02* (2006.01)
*B65D 83/00* (2006.01)

(52) U.S. Cl.
CPC ..... *B65D 1/0215* (2013.01); *B65D 1/02* (2013.01); *B65D 1/0246* (2013.01);
(Continued)

(58) Field of Classification Search
CPC .. B65D 1/0215; B65D 1/0276; B65D 1/0246; B65D 2501/0027; B65D 83/0055;
(Continued)

(56) References Cited

U.S. PATENT DOCUMENTS 2,808,167 A * 10/1957 Samuel ..... A47J 41/0077 215/13.1
3,513,531 A * 5/1970 Zeunik ..... A47J 41/022 29/419.2

(Continued)

FOREIGN PATENT DOCUMENTS

EP 0 403 259 A1 12/1990
JP 2003-192031 A 7/2003

(Continued)

OTHER PUBLICATIONS

Jul. 26, 2019 Extended Search Report issued in European Patent Application No. 16878206.8.

(Continued)

*Primary Examiner* — Ernesto A Grano
(74) *Attorney, Agent, or Firm* — Oliff PLC

(57) ABSTRACT

A double-walled container includes a plurality of ribs. The plurality of ribs include at least one expanded diameter part rib whose upper end is disposed immediately below at least one diameter expansion part of ring and at least one intermittent part rib whose upper end is disposed immediately below at least one intermittent part of ring located immediately below at least one air introduction hole. The at least one intermittent part includes an extending portion extending beyond the upper end of the at least one expanded diameter part rib.

2 Claims, 6 Drawing Sheets

(52) U.S. Cl.
CPC ..... *B65D 1/0276* (2013.01); *B65D 23/02* (2013.01); *B65D 83/0055* (2013.01); *B65D 2501/0027* (2013.01)

(58) Field of Classification Search
CPC . B65D 23/02; B65D 1/02; B65D 1/81; B65D 1/3806; B65D 7/22; A61J 9/001; A47J 41/02; A47J 41/022; A47J 41/028; A47J 41/0072; A47J 41/0077
USPC ..... 215/12.1, 11.1
See application file for complete search history.

(56) References Cited

U.S. PATENT DOCUMENTS

| | | | | |
|---|---|---|---|---|
| 4,330,066 | A * | 5/1982 | Berliner | B65D 23/00 215/12.1 |
| 4,372,455 | A * | 2/1983 | Cochran | B29C 49/0073 215/385 |
| 4,868,026 | A * | 9/1989 | Shimizu | B29C 45/1643 428/36.7 |
| 4,892,230 | A * | 1/1990 | Lynn, Jr. | B65D 23/02 215/12.1 |
| 5,513,761 | A * | 5/1996 | Kobayashi | B05B 11/00412 215/12.1 |
| 6,244,454 | B1 * | 6/2001 | Yoshioka | B29C 49/0005 220/62.22 |
| 6,266,943 | B1 * | 7/2001 | Nomoto | B05B 11/3047 53/410 |
| 6,670,007 | B1 * | 12/2003 | Safian | B29C 49/22 215/11.3 |
| 9,211,993 | B2 * | 12/2015 | Tom | B67D 7/025 |
| 9,650,169 | B2 * | 5/2017 | Tom | B67D 7/025 |
| 9,815,610 | B2 * | 11/2017 | Yamada | B65D 83/0055 |
| 2004/0060889 | A1 * | 4/2004 | Yoneyama | B65D 1/0215 215/12.1 |
| 2004/0069735 | A1 * | 4/2004 | Yoneyama | B29C 49/0073 215/12.1 |
| 2007/0051687 | A1 * | 3/2007 | Olson | B21D 51/38 215/44 |
| 2015/0298890 | A1 * | 10/2015 | Miyairi | B65D 1/0215 215/12.1 |

FOREIGN PATENT DOCUMENTS

| | | | |
|---|---|---|---|
| JP | 2007-290746 | A | 11/2007 |
| JP | 2012-076758 | A | 4/2012 |
| JP | 2014-091537 | A | 5/2014 |
| JP | 2014-091538 | A | 5/2014 |
| JP | 2014-091581 | A | 5/2014 |
| JP | 2016-101966 | A | 6/2016 |

OTHER PUBLICATIONS

May 21, 2019 Office Action issued in Korean Patent Application No. 10-2018-7017339.
Feb. 14, 2017 International Search Report issued in International Patent Application No. PCT/JP2016/083838.
Feb. 27, 2019 Office Action issued in Chinese Patent Application No. 201680074924.3.

* cited by examiner

A-A section

B-B section

C-C section

D-D section

E-E section

DOUBLED-WALLED CONTAINER

TECHNICAL FIELD

The present disclosure relates to a double-walled container including a bottle shaped outer layer body having a mouth, a trunk and a bottom and an inner layer body accommodated inside the outer layer body and configured to be deformed to undergo volume reduction, and in particular, relates to a double-walled container that permits both sufficient securing of an air passage from an air introduction hole and stabilization of work of plugging a dispensing tool into a mouth.

BACKGROUND

As a container to contain cosmetics such as face lotion, shampoo, rinse, liquid soap, food seasoning, or the like, a double-walled container that includes an inner layer body having an accommodation part configured to accommodate the contents and an outer layer body configured to separatably accommodate the inner layer body is known (see, for example, Patent Literature 1). In this container, the contents are dispensed with the inner layer body deformed to undergo volume reduction, while ambient air is introduced between the inner layer body and the outer layer body from an air introduction hole provided in the mouth of the outer layer body to hold the external form of the container. A container of this type permits dispense without displacing the contents with ambient air, thus contact of the contents with ambient air is reduced and degradation or deterioration of the quality of the contents can be suppressed.

CITATION LIST

Patent Literature

PTL1: JP2007-290746A

SUMMARY

Technical Problem

As such a double-walled container, a lamination separate container also referred to as a delamination container is known. The container is formed by the direct blow molding (Extrusion Blow Molding) of a laminated parison by using a die. In this case, a double-walled container is formed as follows; a synthetic resin for outer layer and a synthetic resin for inner layer, each having low compatibility, are coextuded to obtain a laminated parison, and the laminated parison undergoes blow molding by using a die, and thus is formed in a lamination structure in which the outer layer body and the inner layer body adhere to each other. Thus, after the blow molding, air is compressed and fed from the air introduction hole, for example, or negative pressure suction is applied to the mouth to contract the inner layer body, thus the entire inner layer body is separated from the outer layer body. Subsequently air is sent to inside the inner layer body so that the entire body adheres again to the outer layer body, and the inner layer body can be separated easily from the outer layer body when the contents are dispensed.

However, as described above, in the existing double-walled container, even if the inner layer body is once separated from the outer layer body after the blow molding, the entire exterior surface of the inner layer body again adheres to the entire interior surface of the outer layer body, which causes difficulty in introducing air between the outer layer body and the inner layer body from the air introduction hole when the contents are dispensed, and may result in insufficient separation of the inner layer body or deformation of the outer layer body.

Further, as such a double-walled container, in order to obtain tamper-proof effects, those provided with a dispensing tool such as a dispensing cap plugged into the mouth is known. In this case, a neck ring is formed around the mouth of the double-walled container, and the dispensing tool is plugged into the mouth with the undersurface of the neck ring supported with a support tool. However, in the existing double-walled container, a neck ring having an expanded diameter is formed by blow molding. The diameter is expanded by bending the peripheral wall forming the mouth so that the wall projects radially outward. Thus, during plugging, the neck ring deflects as it is crushed in the vertical direction, and a stabilized plugging work cannot be realized.

The present disclosure is provided to solve the above existing problem, and proposes a double-walled container that permits both sufficient securing of an air passage from an air introduction hole and stabilization of work of plugging a dispensing tool into a mouth

Solution to Problem

That is to say, the present disclosure is configured as follows:

1. A double-walled container including a bottle-shaped outer layer body having a cylindrical mouth, a trunk that is connected to the mouth and has a diameter larger than that of the mouth, and a bottom connected to the trunk; and an inner layer body that is accommodated inside the outer layer body, has a shape corresponding to that of the outer layer body and is configured to be deformed to undergo volume reduction, the mouth being provided with at least one air introduction hole that passes through the outer layer body and introduces air between the outer layer body and the inner layer body, the double-walled container further including an engaging part for plug used for fitting a dispensing tool to the mouth by plugging, a neck ring provided around the mouth, and a plurality of ribs that are provided on at least an upper part of the trunk and extends in a direction from the mouth toward the bottom; in which the neck ring includes at least one diameter expansion part of ring whose diameter is expanded by bending a peripheral wall forming the mouth so that it projects radially outward and at least one intermittent part of ring that is circumferentially adjacent to the at least one diameter expansion part of ring and whose diameter is less expanded than that of the at least one diameter expansion part of ring, the plurality of ribs include at least one expanded diameter part rib whose upper end is disposed immediately below the at least one diameter expansion part of ring and at least one intermittent part rib whose upper end is disposed immediately below the at least one intermittent part of ring located immediately below the at least one air introduction hole, and the at least one intermittent part rib includes an extending portion extending beyond the upper end of the at least one expanded diameter part rib;

2. The double-walled container according to 1 above, in which the neck ring is disposed above a lower end of the mouth, and the extending portion extends over the lower end of the mouth.

Advantageous Effect

In the present disclosure, the buckling strength to stress acting on the neck ring during plugging can be improved by at least one intermittent part of ring whose diameter is smaller than that of at least one diameter expansion part of ring of the neck ring. Further, in the present disclosure, once a clearance is formed between the inner layer body and the outer layer body, a plurality of ribs provided on the inner layer body and the outer layer body prevent the inner layer body and the outer layer body from being adhered each other again, and a clearance can be secured around the plurality of ribs. Further, since an extending portion is provided on at least one intermittent part rib, the clearance secured in this manner can be connected to at least one air introduction hole via at least one intermittent part of ring of the neck ring. Thus a sufficient air passage can be secured.

Accordingly, in the present disclosure, a double-walled container that permits both sufficient securing of an air passage from an air introduction hole and stabilization of work of plugging a dispensing tool into a mouth can be provided.

BRIEF DESCRIPTION OF THE DRAWINGS

In the accompanying drawings:

FIG. 4(*b*) illustrates a sectional view taken along a line B-B in FIG. 2;

FIG. 5(*b*) illustrates a sectional view taken along a line D-D in FIG. 2;

FIG. 5(*c*) illustrates a sectional view taken along a line E-E in FIG. 2;

FIG. 6(*b*) illustrates a side view of the double-walled container of Comparative Example 2; and FIG. 6(*c*) illustrates a side view of the double-walled container of Comparative Example 3.

DETAILED DESCRIPTION

The double-walled container 1 according to an embodiment of the present disclosure will be described in more detail below with reference to FIGS. 1 to 5. It is to be noted that, in this specification, the vertical direction refers to upward and downward directions in FIG. 2 on the basis of the erected state of the double-walled container 1.

Figure 1:
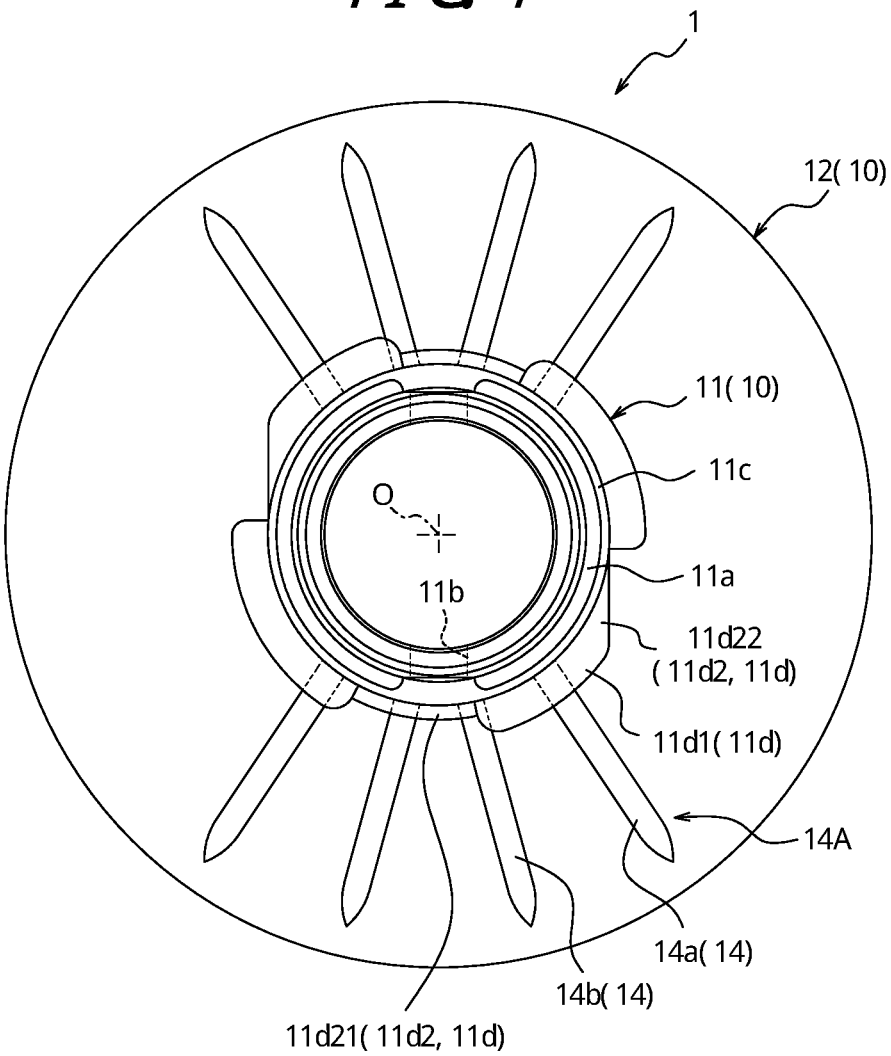
FIG. 1 is a plan view illustrating a double-walled container according to an embodiment of the present disclosure.
Figure 2:
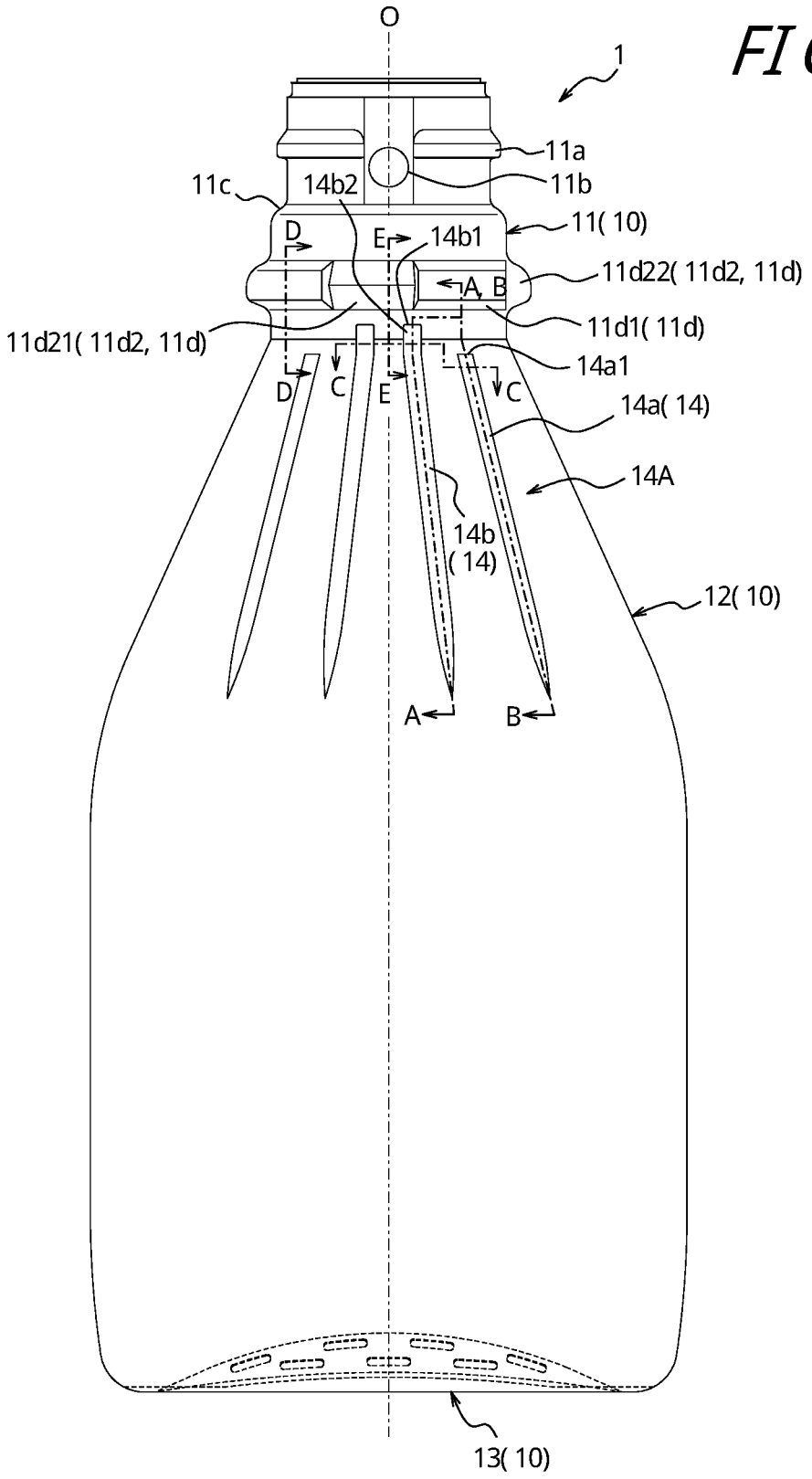
FIG. 2 is a side view of the double-walled container in FIG. 1.
Figure 3:
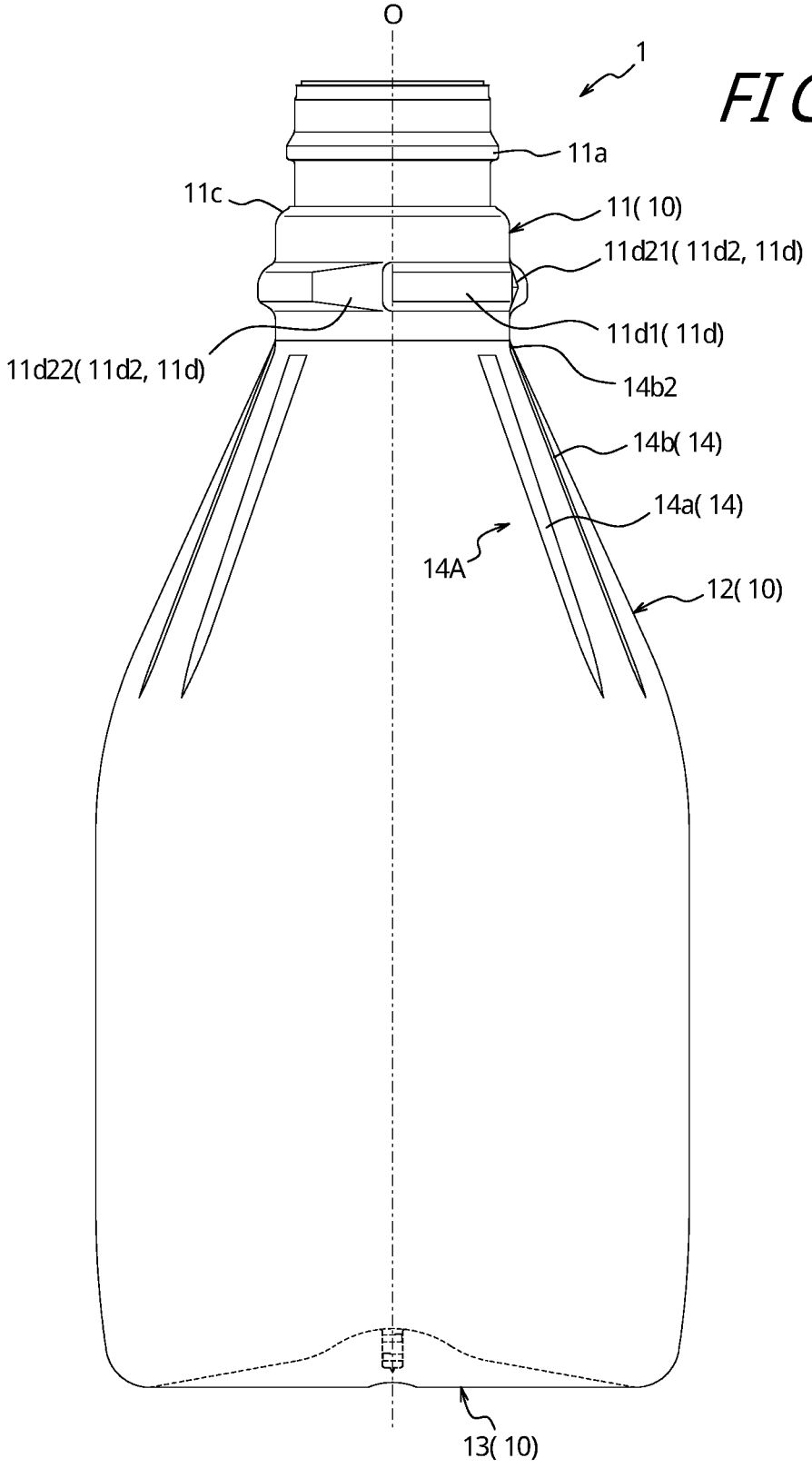
FIG. 3 is a side view of the double-walled container viewed from an angle different from FIG. 2 by 90°.

As illustrated in FIGS. 1 to 3, the double-walled container 1 according to the present embodiment includes a bottle-shaped outer layer body 10 having a cylindrical mouth 11, a trunk 12 including a conical upper part connected to the mouth 11 and a cylindrical lower part, and an approximately disk shaped bottom 13 connected to the trunk 12. The trunk 12 is flexible, can dent when squeezed and recover to its original form from the dent state.

Further, the double-walled container 1 includes an inner layer body (not illustrated), which has a shape corresponding to that of the outer layer body 10 and is configured to be deformed to undergo volume reduction. The inner layer body is formed into a bag shape that is thinner than the outer layer body 10. The external surface thereof separately adheres to the interior surface of the outer layer body 10. The opening of the inner layer body is connected to the open end of the mouth 11 of the outer layer body 10, and the inside of the inner layer body is an accommodation part connected to the opening. Cosmetics such as face lotion, shampoo, rinse, liquid soap, food seasoning, or the like are accommodated in the accommodation part.

In this embodiment, the double-walled container 1 is configured as a lamination separation container also referred to as a delamination container, which has a lamination structure in which the inner layer body separately adheres to the interior surface of the outer layer body 10. The structure is formed by coextruding a synthetic resin having low compatibility for outer layer and a synthetic resin for inner layer to obtain a laminated parison, and applying a blow molding to the laminated parison by using a die. It is to be noted that the double-walled container 1 is obtained not only by the aforementioned direct flow molding (Extrusion Blow Molding) but also may be obtained as a lamination separation container formed by subjecting a preform of a lamination structure to biaxial stretching blow-molding, for example. Further, the double-walled container 1 may be configured by separately forming the outer layer body 10 and the inner layer body, and subsequently incorporating the inner layer body into the outer layer body 10.

For example, a dispensing tool (not illustrated) such as a dispensing cap provided with a valve for dispensing, various types of nozzles or dispensing pump is fitted to the mouth 11 by plugging it, and the contents are dispensed through such dispensing tools. In this double-walled container 1, when a dispensing cap provided with a valve for dispensing is fitted to the mouth 11, the contents can be dispensed from the mouth 11 by squeezing the trunk 12 of the outer layer body 10. When the outer layer body 10 restores to its original state after the contents are dispensed, ambient air is introduced between the outer layer body 10 and the inner layer body from an air introduction hole 11*b* described later. Thus the outer layer body 10 can be restored to its original state with the volume of the accommodation part of the inner layer body reduced. Therefore, even after the contents are dispensed, ambient air will not flow from the mouth 11 into the accommodation part of the inner layer body. Thus the contents accommodated in the accommodation part will not come in contact with air, and thus are prevented from being deteriorated. Further, when the outer layer body 10 is inclined, the contents accommodated in the accommodation part of the inner layer body can be dispensed from the mouth 11 by its own weight. It is to be noted that, when a pump is fitted to the mouth 11, an inflexible outer layer body 10 may be used.

The mouth 11 is provided with an engaging protrusion 11*a* as an engaging part for plugging the mouth 11 with a dispensing tool, which comes into undercut engagement. The engaging protrusion 11*a* is adapted for undercut engagement with an engaging groove provided in the inner circumferential surface of a fitting tube of the dispensing tool, and thus can engage the dispensing tool with the mouth 11. In a plan view, the engaging protrusion 11*a* forms a pair of circular arcs having an intermittent part at two sections opposed to each other over the central axis O of the double-walled container 1 aligned with the central axis of the mouth 11.

In a slightly lower portion of the intermittent part of the engaging protrusion 11*a* in the mouth 11 of the outer layer body 10, a circular air introduction hole 11*b* is provided at two portions opposed to each other over the axis O. A pair of these air introduction holes 11*b* pass through the outer layer body 10 and communicates between the outer layer body 10 and the inner layer body, and can introduce air when the inner layer body is separated from the outer layer body 10.

A step 11*c* formed by the peripheral wall that forms the mouth 11 is provided below the air introduction hole 11*b* of the mouth 11. The peripheral wall is bent so that the diameter thereof expands downward. The step 11*c* permits ambient air to be introduced into the air introduction hole lib. On the other hand, when the dispensing tool including an ambient air introduction valve that prevents air from leaking from the air introduction hole 11*b* is fitted to the mouth 11, the step 11*c* adheres to the lower end of a fitting tube of the dispensing tool and prevents the air from leaking from the lower end of the fitting tube.

A neck ring 11*d* is provided below the step 11*c* of the mouth 11. The neck ring 11*d* includes four diameter expansion parts of ring 11*d*1. Each of them is disposed at an interval in the circumferential direction and has an expanded diameter obtained by bending the peripheral wall that forms the mouth 11 so that it projects radially outward (see FIG. 5(*b*)). Further, four intermittent parts of ring 11*d*2 whose diameter is smaller than the aforementioned diameter expansion part of ring 11*d*1 are disposed between each of the diameter expansion parts of ring 11*d*1.

Figure 5A:
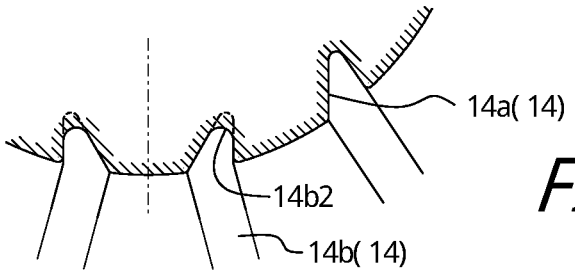
FIG. 5(*a*) illustrates a sectional view taken along a line C-C in FIG. 2.
Figure 5B:
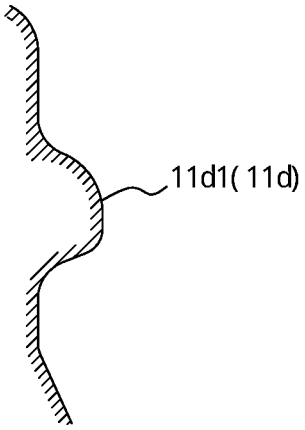
Figure 5C:
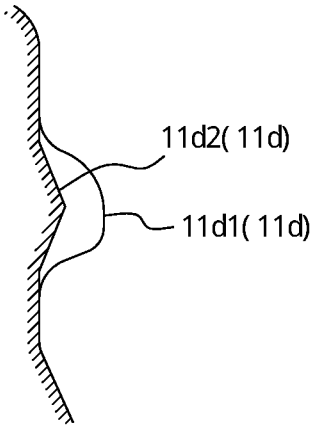

The four intermittent parts of ring 11*d*2 are formed of two first intermittent parts of ring 11*d*21 located immediately below two air introduction holes 11*b* and two second intermittent parts of ring 11*d*22 located between these first intermittent parts of ring 11*d*21 in the circumferential direction. As illustrated in FIG. 5(*c*), the first intermittent part of ring 11*d*21 is formed by bending the peripheral wall that forms the mouth 11 so that it has a vertically V-shaped profile. Further, as illustrated in FIG. 1, the second intermittent part of ring 11*d*22 is formed by bending the peripheral wall that forms the mouth 11 so that it has a horizontally V-shaped profile A pair of rib groups 14A corresponding to a pair of air introduction holes 11*b* are formed on the upper part of the trunk 12. Each of the pair of rib groups 14A is formed of four ribs 14 radially extending from the mouth 11 toward the bottom 13. The four ribs 14 are formed of two expanded diameter parts of rib 14*a* each having an upper end 14*a*1 disposed immediately below the diameter expansion part of ring 11*d*1 and two intermittent parts of rib 14*b* each having an upper end 14*b*1 disposed immediately below the first intermittent part of ring 11*d*21. Each intermittent part rib 14*b* includes an extending portion 14*b*2 extending beyond the upper end 14*a*1 of the expanded diameter part rib 14*a*.

Figure 4A:
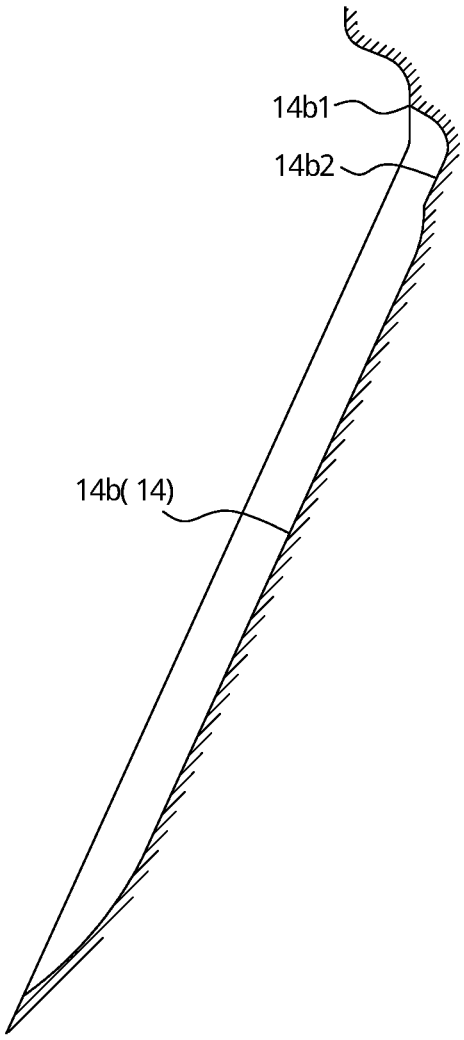
FIG. 4(*a*) illustrates a sectional view taken along a line A-A in FIG. 2.
Figure 4B:
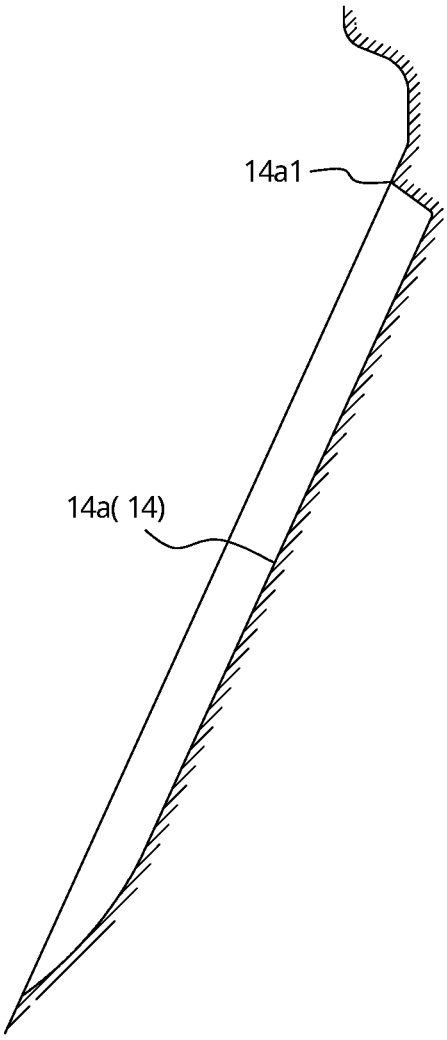

Further, as illustrated in FIGS. 4(*a*), 4 (*b*) and 5(*a*), four ribs 14 each has a recess groove concaving radially inward. Further, a depth of the recess groove formed by the extending portion 14*b*2 is shallower than that of the portion immediately below the extending portion 14*b*2. Moreover, the upper end of the extending portion 14*b*2, that is, the upper end 14*b*1 of the intermittent part rib 14*b* extends to the lower part of the mouth 11. In other words, the neck ring 11*d* is provided above the lower end of the mouth 11, and the extending portion 14*b*2 extends over the lower end of the mouth 11.

Since the double-walled container 1 is provided with such a rib group 14A, when the inner layer body is once separated from the outer layer body 10, it is difficult for the ribs of inner layer body to adhere the ribs 14 of the outer layer body 10. Thus a clearance is maintained between the ribs 14 of outer layer body 10 and the ribs of inner layer body. Further, since the first intermittent part of ring 11*d*21 is disposed immediately below the air introduction hole 11*b* and the upper end 14*b*1 of the extending portion 14*b*2 of the intermittent part rib 14*b* is disposed immediately below the first intermittent part of ring 11*d*21, the clearance maintained between the ribs 14 of outer layer body 10 and the ribs of the inner layer body can be connected to the air introduction hole lib.

For example, after a blow molding of this double-walled container 1, when the inner layer body is contracted by negative pressure suction and is separated entirely from the outer layer body 10 and subsequently air is sent into the inner layer body, the other parts of the inner layer body can be adhered to the inner surface of the outer layer body 10 while a clearance is maintained between the ribs 14 of outer layer body 10 and the ribs of inner layer body and between the first intermittent part of ring 11*d*21 of outer layer body 10 and the first intermittent part of ring of inner layer body. Therefore, when the contents are accommodated in the inner layer body and then are dispensed from the mouth 11, the clearance between the first intermittent part of ring 11*d*21 and the rib 14 serves as an air passage, and thus ambient air entering from the air introduction hole 11*b* can be easily introduced between the outer layer body 10 and the inner layer body on the side of the bottom 13 of the trunk 12. Thus the inner layer body can be easily separated from the outer layer body 10, and insufficient separation of the inner layer body and deformation of the outer layer body 10 of the double-walled container 1 can be prevented.

Further, the mouth 11 is subjected to little stretch processing during blow molding, and thus is formed to be thicker than the trunk 12. Therefore, it is more difficult for such a thick mouth 11 to secure an air passage than for the trunk 12. However, as mentioned above, an air passage can be secured more positively by extending the extending portion 14*b*2 over the lower end of the mouth 11.

Further, since the double-walled container 1 is provided with the neck ring 11*d*, when a dispensing tool is fitted to the mouth 11 by plugging, the mouth 11 can be plugged with the dispensing tool with the undersurface of the expanded diameter part rib 14*a* of the neck ring 11*d* supported with a support tool. Further, since the neck ring 11*d* is provided with the intermittent part of ring 11*d*2 whose diameter is smaller than that of the diameter expansion part of ring 11*d*1, the intermittent part of ring 11*d*2 can be used as a column part, and thus the buckling strength of the neck ring 11*d* to the stress during plugging can be improved. Therefore, in the double-walled container 1, stabilization of work of plugging a dispensing tool into the mouth 11 can be realized.

As described above, the double-walled container 1 according to this embodiment includes a bottle-shaped outer layer body 10 having a cylindrical mouth 11, a trunk 12 that is connected to the mouth 11 and has a diameter larger than that of the mouth 11, and a bottom 13 connected to the trunk 12, and an inner layer body that is accommodated inside the outer layer body 10, has a shape corresponding to the shape of the outer layer body 10 and is configured to be deformed to undergo volume reduction. The mouth 11 is provided with at least one air introduction hole 11*b* that passes through the outer layer body 10 and introduces air between the outer layer body 10 and the inner layer body.

Further, the double-walled container 1 includes an engaging part for plug (engaging protrusion 11*a*) that is provided in the mouth 11 for fitting a dispensing tool to the mouth 11 by plugging, a neck ring 11*d* provided around the mouth 11 and a plurality of ribs 14 provided at least on the upper part of the trunk 12 and extending from the mouth 11 toward the bottom 13.

Further, in the double-walled container 1, the neck ring 11*d* includes at least one diameter expansion part of ring 11*d*1 whose diameter is expanded by bending the peripheral wall forming the mouth 11 so that it projects radially outward and at least one intermittent part of ring 11*d*2 that is circumferentially adjacent to the at least one diameter expansion part of ring 11*d*1 and whose diameter is less expanded than that of the at least one diameter expansion part of ring 11*d*1; the plurality of ribs 14 include at least one expanded diameter part rib 14*a* whose upper end 14*a*1 is disposed immediately below the at least one diameter expansion part of ring 11*d*1 and at least one intermittent part rib 14*b* whose upper end 14*b*1 is disposed immediately below the at least one intermittent part of ring 11*d*2 located immediately below the at least one air introduction hole 11*b*; and at least one intermittent part rib 14*b* includes an extending portion 14*b*2 extended over the upper end of the at least one expanded diameter part rib 14*a*.

Therefore, the double-walled container 1 according to this embodiment permits both sufficient securing of an air passage from the air introduction hole 11*b* and stabilization of work of plugging a dispensing tool into a mouth.

Further, in the double-walled container 1 according to this embodiment, the neck ring 11*d* is provided above the lower end of the mouth 11, and the extending portion 14*b*2 extends over the lower end of the mouth 11.

Therefore, in the double-walled container 1 according to this embodiment, an air passage can be secured in more positive manner.

The present disclosure is not limited to the above embodiments, and various changes may be made without departing from the gist of the present disclosure. For example, in the above embodiments, the mouth 11 is provided with a pair of air introduction holes lib, and a pair of intermittent part of rings 11*d*2 and a pair of rib groups 14A are provided corresponding to the air introduction holes lib. However, the numbers of air introduction holes lib, intermittent parts of ring 11*d*2 and rib groups 14A are respectively not limited to 2, and may be 1 or 3 or more. Further, the number of ribs 14 in the rib group 14A can be appropriately changed. Further, the rib 14 is only required to be provided at least on the upper part of the trunk 12 and to extend from the mouth 11 toward the bottom 13. The shape and length thereof can be appropriately changed. Further, the ribs 14 are not limited to those forming a recess groove concaving radially inward, and may be those forming a protruding section projecting radially outward. Moreover, although the mouth 11, the trunk 12 and the bottom 13 are illustrated as a circular shape in plan view, they may have other shapes such as ellipse.

Examples

In order to confirm the effects of the present disclosure, double-walled containers as illustrated in FIGS. 1 to 5 were produced as Examples. Further, their neck ring strengths were measured and whether or not a dispensing cap can be fitted by plugging was confirmed. Further, the contents were dispensed from the dispensing cap fitted and the trunk was observed for smooth restoration to confirm if sufficient air passage was secured. Moreover, as Comparative Examples 1 to 3, double-walled containers each configured as those illustrated in FIGS. 6 (*a*) to (*c*) were produced, and as in the case of the Examples, neck ring strength was measured and whether or not a dispensing tool can be fitted by plugging and if sufficient air passage is secured were confirmed.

Both in the Example and Comparative Examples 1 to 3, the double-walled container was formed by direct blow molding (Extrusion Blow Molding) and the volume was defined as 200 ml. Further, the plugging force was defined as 300N. The results are shown in Table 1.

TABLE 1

Figure 6A:
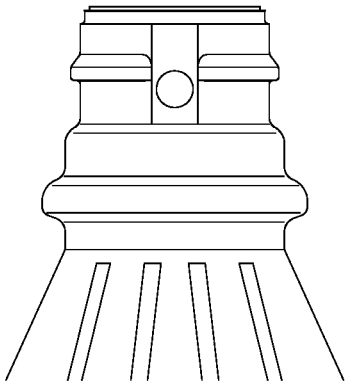
FIG. 6(*a*) illustrates a side view of the double-walled container of Comparative Example 1.
Figure 6B:
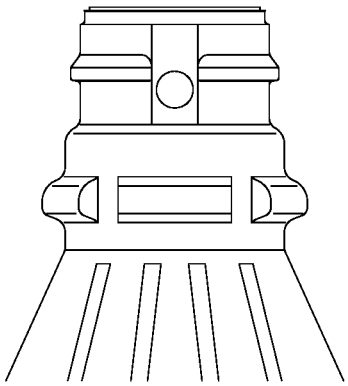
Figure 6C:
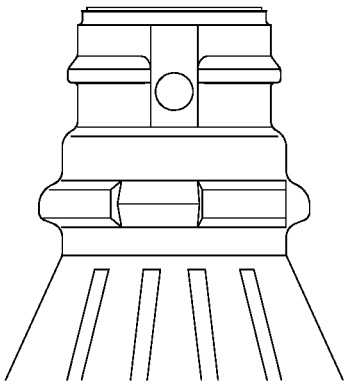

| | Example | Comparative Example 3 | Comparative Example 2 | Comparative Example 1 |
|---|---|---|---|---|
| Structure | FIGS. 1 to 5 | FIG. 6(c) | FIG. 6(b) | FIG. 6(a) |
| Neck strength (N) | 650 | 650 | 650 | 260 |
| Plugging | available | available | available | N/A |
| Air passage | secured | not secured | not secured | — |

As obvious from Table 1, in Comparative Example 1 of FIG. 6(*a*) in which the neck ring has no intermittent part and the upper ends of all four ribs have the same height, the neck ring strength was not enough, and the dispensing cap could not be plugged into the mouth. Thus the air passage securing state could not be confirmed. Further, in Comparative Example 2 of FIG. 6(*b*) in which the intermittent part of the neck ring is not located immediately below the air introduction hole and the upper ends of all four ribs have the same height, the dispensing cap could be plugged, but air passage could not be secured sufficiently. Further, in Comparative Example 3 of FIG. 6(*c*) in which the intermittent part of the neck ring is located immediately below the air introduction hole and the upper ends of all four ribs have the same height, the dispensing cap could be plugged, but air passage could not be secured sufficiently. Whereas in Example illustrated in FIGS. 1 to 5 in which the intermittent part of the neck ring is located immediately below the air introduction hole and the upper end of the extending portion of the rib is located immediately below the intermittent part, both plugging and securing of enough air passage were possible.

From the above results, when the intermittent part of the neck ring is disposed immediately below the air introduction hole and the upper end of the extending portion of the rib is disposed immediately below the intermittent part in accordance with the present disclosure, it was confirmed that both plugging of a dispensing tool and securing of enough air passage could be realized.

REFERENCE SIGNS LIST

1: Double-walled container
10: Outer layer body
11: Mouth
11*a*: Engaging protrusion (engaging part for plug)
11*b*: Air introduction hole
11*c*: Step
11*d*: Neck ring
11*d*1: Diameter expansion part of ring
11*d*2: Intermittent part of ring
11*d*21: First intermittent part of ring
11*d*22: Second intermittent part of ring
12: Trunk
13: Bottom
14: Rib
14A: Rib group
14*a*: Expanded diameter part rib
14*a*1: Upper end of expanded diameter part rib
14*b*: Intermittent part rib
14*b*1: Upper end of intermittent part rib
14*b*2: Extending portion
O: Axis

The invention claimed is:

1. A double-walled container comprising: an outer layer body that is bottle-shaped and that includes a mouth, the mouth being cylindrical, a trunk that is connected to the mouth and has a diameter larger than a diameter of the mouth, and a bottom connected to the trunk; and an inner layer body that is accommodated inside the outer layer body, has a shape corresponding to a shape of the outer layer body and is configured to be deformed to undergo volume reduction, the mouth being provided with at least one air introduction hole that passes through the outer layer body and introduces air between the outer layer body and the inner layer body, the double-walled container further comprising: an engaging part for plug used for fitting a dispensing tool to the mouth by plugging; a neck ring provided around the mouth; and a plurality of ribs that are provided on at least an upper part of the trunk and extends in a direction from the mouth toward the bottom; wherein the neck ring includes at least one ring diameter expansion part whose diameter is expanded by bending a peripheral wall forming the mouth so that it projects radially outward and at least one ring intermittent part that is circumferentially adjacent to the at least one ring diameter expansion part and whose diameter is less expanded than that of the at least one ring diameter expansion part, and the plurality of ribs include at least one expanded diameter part rib whose upper end is disposed immediately below the at least one ring diameter expansion part and at least one intermittent part rib whose upper end is disposed immediately below the at least one ring intermittent part located immediately below the at least one air introduction hole, and the at least one intermittent part rib includes an extending portion extending beyond the upper end of the at least one expanded diameter part rib.

2. The double-walled container according to claim 1, wherein the neck ring is disposed above a lower end of the mouth, and the extending portion extends over the lower end of the mouth.

* * * * *